US005219127A

United States Patent [19]

Boldrini et al.

[11] Patent Number: 5,219,127

[45] Date of Patent: Jun. 15, 1993

[54] METHOD AND DEVICE FOR FEEDING AND CHANGING REELS ON A MANUFACTURING MACHINE

[75] Inventors: Fulvio Boldrini, Ferrara; Antonio Gamberini, Bologna, both of Italy

[73] Assignee: G.D. Societa' Per Azioni, Bologna, Italy

[21] Appl. No.: 619,476

[22] Filed: Nov. 29, 1990

[30] Foreign Application Priority Data

Dec. 18, 1989 [IT] Italy ..... 3770 A/89

[51] Int. Cl.[5] ..... B65H 19/16; B65H 19/30

[52] U.S. Cl. ..... 242/58.4; 242/58.6

[58] Field of Search ..... 242/58.6, 58.4, 58.1, 242/58.3

[56] References Cited

U.S. PATENT DOCUMENTS

| | | | |
|---|---|---|---|
| 3,495,783 | 2/1970 | Headington et al. | 242/58.4 |
| 4,238,261 | 12/1980 | Tetro | 242/58.4 X |
| 4,415,127 | 11/1983 | Seragnoli | 242/58.1 |
| 4,441,662 | 4/1984 | Seragnoli | 242/58 |
| 4,481,053 | 11/1984 | Tokuno et al. | 242/58.4 X |
| 4,543,152 | 9/1985 | Nozaka | 242/58.4 X |
| 4,589,811 | 5/1986 | Riccardo et al. | 242/58.6 X |
| 4,629,531 | 12/1986 | Kataoka | 242/58.4 X |
| 4,645,558 | 2/1987 | Sato | 242/56 R X |
| 4,757,951 | 7/1988 | Ludszeweit | 242/58.1 |
| 4,798,349 | 1/1989 | Manservisi | 242/58.6 X |
| 4,842,681 | 6/1989 | Bader et al. | 242/58.4 X |
| 4,875,632 | 10/1989 | Kataoka | 242/56.2 |
| 4,896,842 | 1/1990 | Focke et al. | 242/58.6 |
| 4,953,805 | 9/1990 | Rauh | 242/58.6 |
| 5,004,174 | 4/1991 | Deutschle | 242/58.6 |

*Primary Examiner*—Daniel P. Stodola
*Assistant Examiner*—Michael R. Mansen
*Attorney, Agent, or Firm*—Marshall, O'Toole, Gerstein, Murray & Borun

[57] ABSTRACT

A method and device for feeding and changing reels on a manufacturing machine, whereby reels of strip material arranged side by side are fed successively into a first operating position substantially coplanar to a second operating position wherein the strip material is unwound normally. Each reel is supported in the second position by an arm which, as the reel in the second position runs out, releases the core of the empty reel, and picks up the reel in the first position; which reel has already been rotated, in the first position, by an unwinding device designed to feed the strip material on the reel in the first position at the same speed as the strip material on the reel in the second position.

13 Claims, 2 Drawing Sheets

METHOD AND DEVICE FOR FEEDING AND CHANGING REELS ON A MANUFACTURING MACHINE

BACKGROUND OF THE INVENTION

The present invention relates to a method of feeding and changing reels on a manufacturing machine. Hereinafter, the term "manufacturing machine" is intended to mean any machine employing wrapping or packing material in strip form.

Manufacturing machines, such as the one referred to in U.S. Pat. No. 4,441,662, are known to feature a reel feeding and changing device comprising a storage fixture supporting a number of reels arranged side by side, and designed to feed them successively to a pickup station where they are picked up one by one by a carriage and fed on to a reel-off platform. The platform is usually designed to accommodate two reels, one supplying the manufacturing machine, and a second standby reel loaded off the carriage. As soon as the first reel runs out, the platform is rotated to replace the first reel with the second and receive another standby reel.

On known reel feeding and changing devices of the aforementioned type, the storage fixture assigned to the reel-off platform constitutes a relatively cumbersome passive element requiring an active intermediate device, the carriage, for transferring the reels on to the reel-off platform.

SUMMARY OF THE INVENTION

The aim of the present invention is to provide a reel feeding and changing method enabling the intermediate device to be dispensed with.

With this aim in view, according to the present invention, there is provided a method of feeding and changing reels of strip material on a manufacturing machine, characterised by the fact that it comprises stages consisting in successively feeding, via feeding means, a number of reels along a storage fixture, so that a first of said reels occupies, on said storage fixture, a first position wherein said first reel is supported for rotation about its axis, said first position being adjacent to a second position occupied successively by each said reel as said strip material is unwound normally along a given path, said reel in said second position being mounted for rotation on a transfer element designed to move between said first and second position; in turning said first reel about its axis so as to unwind said strip material along said given path and at substantially the same speed as that at which said reel in said second position is unwound; in unloading said reel in said second position off said transfer element; and in moving said transfer element into said first position, to pick up said first reel and move it into said second position as said strip material on the same is unwound.

The above method provides for employing the storage fixture as an active element and, as the active reel is about to run out, for unwinding the standby reel while the active reel is still on the storage fixture. The storage fixture and transfer element thus combine to form the reel-off platform of the known state of the art, thus enabling the transfer carriage to be dispensed with.

According to the present invention, there is also provided a device for feeding and changing reels of strip material on a manufacturing machine, characterised by the fact that it comprises a storage fixture for said reels; means for successively feeding said reels along said storage fixture, in a direction substantially parallel to their axis, and so as to set a first of said reels in a first given position on said storage fixture; means for supporting said first reel in said first position and in such a manner as to rotate about is axis; a transfer element for successively transferring said reels from said first position to a second normal unwinding position adjacent to said first position, said transfer element being connectable in rotary manner to each said reel for supporting the same in said second position; and means for unwinding said strip material off said reels in said first and said second position at normal unwinding speed and along a given path.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
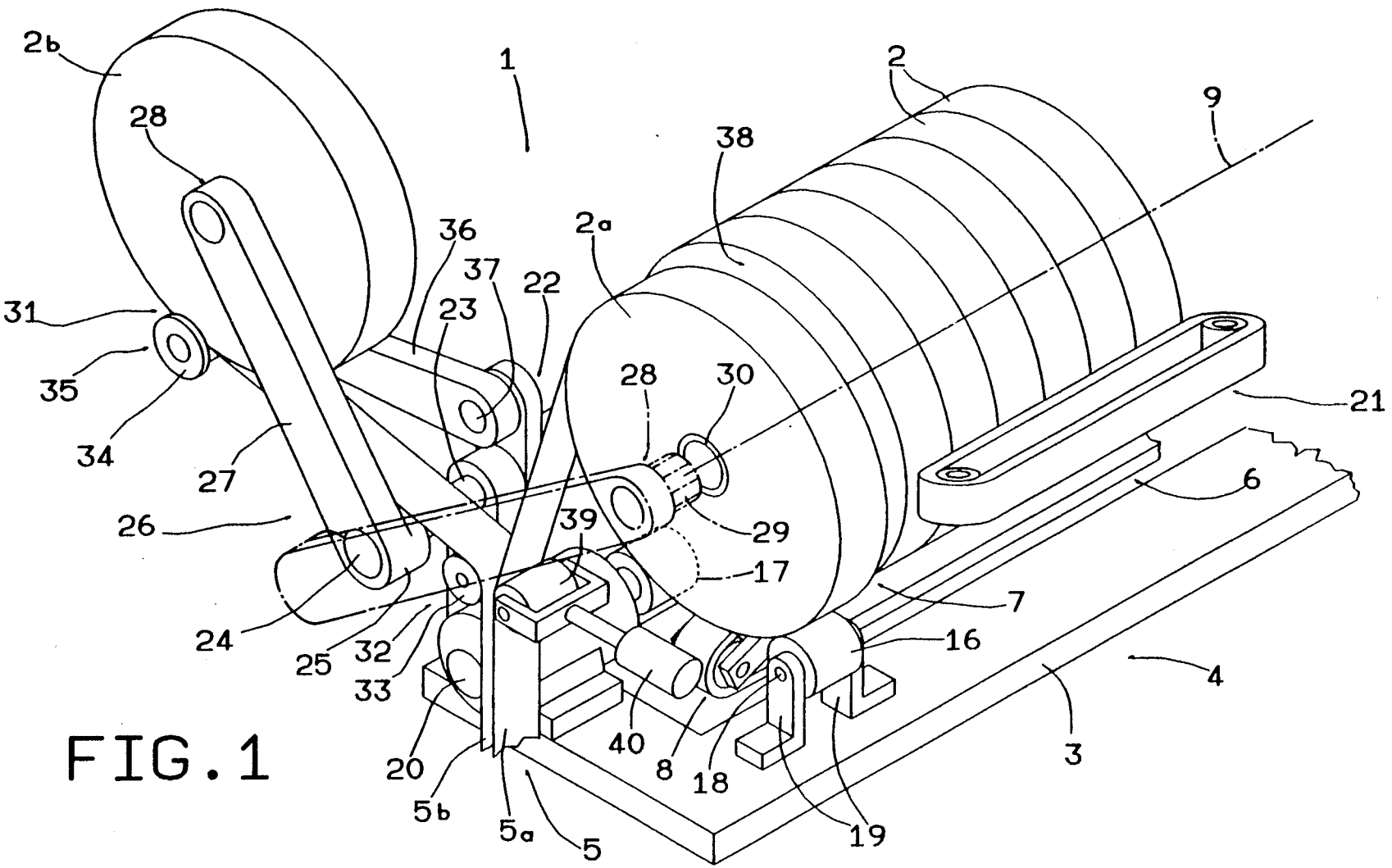
FIG. 1 shows a schematic view in perspective of a preferred embodiment of the reel feeding and changing device according to the present invention.

Number 1 in FIG. 1 indicates a device for feeding and changing reels 2, said device 1 being mounted on a supporting plate 3 forming part of the bed of a manufacturing machine indicated as a whole by 4 and consisting, for example, of a packing machine wherein strips 5 of wrapping material are fed off reels 2.

Device 1 comprises a storage fixture 6 designed to house a number of standby reels 2 arranged on edge substantially contacting one another, and which are fed successively into an unloading position 7 occupied in FIG. 1 by reel 2*a*. Reels 2 are fed into position 7 by a reversible conveyor 8 extending parallel to axis 9 of reels 2 on storage fixture 6, and comprising a looped belt 10, the top branch of which extends over a supporting plate 11 integral with plate 3, and is looped about a front pulley 12 located at unloading position 7, frontwards of the front edge of plate 11 and beneath reel 2*a*.

Figure 2:
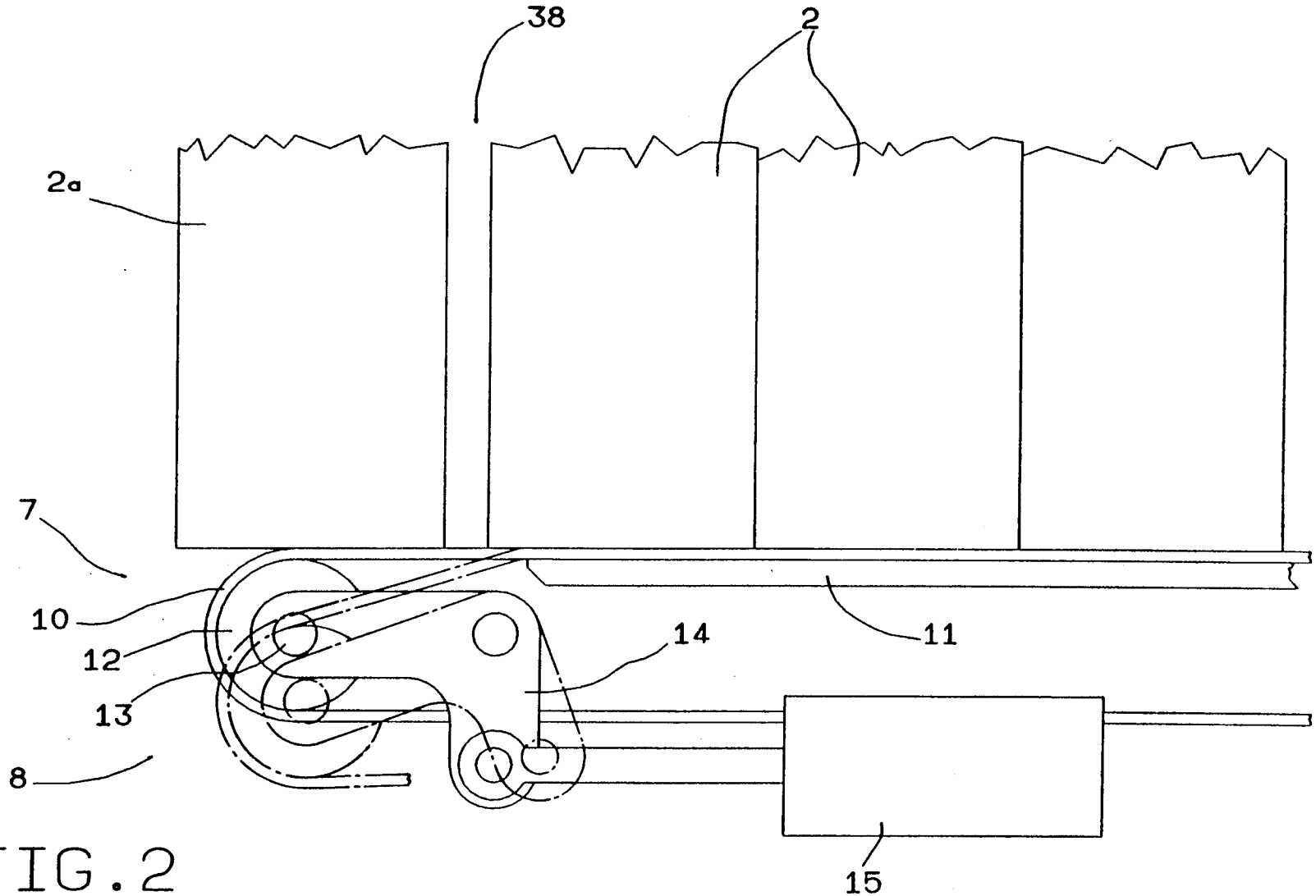
FIG. 2 shows a side view of a detail in FIG. 1.

As shown in FIG. 2, pulley 12 is mounted for rotation on a pin 13 perpendicular to axis 9 and mounted on a substantially L-shaped bracket 14. Bracket 14 pivots centrally on a support (not shown) integral with plate 11, so as to turn, by virtue of an actuator 15 and about an axis parallel to that of pin 13, between a raised position, wherein a front portion of the top branch of belt 10 contacts the edge of reel 2*a*, and a lowered position wherein said front portion of belt 10 is detached from and releases the edge of reel 2*a* on to two rollers 16 and 17 supported on plate 3 on opposite sides of conveyor 8 and at least one of which is powered.

In the FIG. 1 example, roller 16 is an idle roller mounted for rotation about a pin 18 parallel to axis 9 and supported at opposite ends on two brackets 19 in turn supported on plate 3. Roller 17, on the other hand, is fitted on to the output shaft of a motor 20 parallel to axis 9 and supported on plate 3.

In addition to bottom conveyor 8, storage fixture 6 also comprises a further two reversible conveyors 21 (only one of which is shown in FIG. 1) extending parallel to axis 9 on opposite sides of reels 2 for laterally sustaining the same. Each conveyor 21 is shorter than conveyor 8, so as not to interfere with reel 2*a* in unloading position 7.

Adjacent to motor 20, plate 3 supports an actuating device 22 for moving back and forth an output shaft 23 extending parallel to axis 9 and fitted on its free end with a known actuating device 24 for oscillating a hub 25 coaxial with shaft 23.

Actuating devices 22 and 24 and hub 25 form part of a transfer device 26 also comprising an arm 27 extending radially upwards from hub 25 and fitted on its free end with a known reel-holder head 28, e.g. of the type described in U.S. Pat. No. 4,441,662, the content of which is referred to fully herein.

Head 28 presents a spigot 29 for engaging the core 30 of reels 2 in axially-sliding manner, and designed to move, by virtue of actuating device 24, between a first position, wherein spigot 29 is coaxial with axis 9, and a second position, turned through a given angle counterclockwise in FIG. 1, wherein spigot 29 is coaxial with a reel **2*b* located substantially in the same plane as reel 2*a* and in a normal unwinding position 31**.

Reel **2*b* turns about spigot 29 (counterclockwise in FIG. 1) by virtue of the pull exerted on strip 5*b* of reel 2*b* by a powered unwinding device 32, the output roller 33 of which is arranged contacting strip 5*b*. As it rotates, and close to the point at which strip 5*b* is detached from or clears the reel (2*b*), the periphery of reel 2*b* is maintained transversely fixed by the opposed flanges 34 of a roller 35 maintained contacting the periphery of reel 2*b* by an arm 36 pivoting at point 37 on actuating device 22 and turned in relation to the same (clockwise in FIG. 1**) by an elastic pulling device not shown.

Operation of device 1 will be described commencing with head 28 in the normal unwinding position 31, and with reel **2*b* transferred from storage fixture 6 leaving position 7** vacant.

As of this moment, reel **2*b* is supported on transfer device 26, and is unwound normally by device 32 at the normal unwinding or operating speed, while conveyors 8 and 21 feed reels 2 forward so as to move the lead reel 2*a* into position 7. Bracket 14 is then lowered by actuating device 15, and conveyors 8 and 21 are reversed so as to detach reels 2 from lead reel 2*a* and so form a gap 38 between reel 2*a* and the adjacent reel 2**.

By means of a known device not shown, the end of strip 5 on reel **2*a*, hereinafter indicated 5*a*, is detached from the periphery of reel 2*a*, and motor 20 is operated so as to turn reel 2*a* counter clockwise in FIG. 1 and feed strip 5*a* downwards into the gap defined by roller 33 and an adjacent roller 39 moved towards roller 33 by an actuator 40. Once the end of strip 5*a* has been fed between rollers 33 and 39, along the normal unwinding path of strip 5*b*, motor 20** is stopped.

As reel **2*b* is about to run out, a sensor (not shown) emits a signal for actuvating motor 20, which accelerates reel 2*a* so as to feed strip 5*a* forward at the same speed as strip 5*b*. At this point, actuating device 40 presses strip 5*a* on to strip 5*b*, so that both are unwound at the same speed by device 32**.

Head 28 is then operated in known manner, so as to release core 30 of empty reel **2*b*, and is detached axially from position 31 by actuating device 22; actuating device 24 turns arm 27 clockwise in FIG. 1 to position head 28 coaxially with axis 9; actuator 22 inserts spigot 29 inside core 30 of reel 2*a*, which is rotated by the pull exerted on strip 5*a* by unwinding device 32; and device 24 turns arm 27 counter clockwise in FIG. 1, so as to lift reel 2*a* off rollers 16 and 17, transfer it from position 7 to position 31, and so automatically change empty reel 2*b***.

Storage fixture 6 thus constitutes an active part of device 1, by virtue of standby reel **2*a* being rotated directly in postion 7 of fixture 6, and being kept turning by unwinding device 32 as it is transferred into position 31**.

It should be pointed out that strips **5*a* and 5*b* may be either simply overlapped, or joined by known gumming or welding means (not shown) as they are fed between rollers 33 and 39** and at the same speed along the normal unwinding route.

We claim:

1. A device for feeding and changing reels (2) of strip material (5) on a manufacturing machine (4), characterised by the fact that it comprises a storage fixture (6) for said reels (2); means (8, 21) for successively feeding said reels (2) along said storage fixture (6), in a direction substantially parallel to their axis (9), and so as to set a first (**2*a*) of said reels (2) in a first given position (7) on said storage fixture (6); means (16, 17) for supporting said first reel (2*a*) in said first position (7) and in such a manner as to rotate about is axis (9); a transfer element (26) for successively transferring said reels (2) from said first position (7) to a second normal unwinding position (31) adjacent to said first position (7), said transfer element (26) being connectable in rotary manner to each said reel (2) for supporting the same in said second position (31); and means (32) for unwinding said strip material (5*a*) off said reels (2*a*, 2*b*) in said first and said second position (7, 31**) at normal unwinding speed and along a given path.

2. A device as claimed in claim 1, characterised by the fact that said supporting means comprise first rollers (16, 17) cooperating with the outer periphery of said first reel (**2*a*); at least one (17) of said first rollers being powered for turning said first reel (2*a*) about its axis (9**) at a given speed.

3. A device as claimed in claim 1, characterised by the fact that said feeding means (8, 21) are reversible.

4. A device as claimed in claim 1, characterised by the fact that said transfer element (26) comprises an arm (27) and a reel carrier head (28) integral with a first end of said arm (27); first (24) and second (22) actuating means being connected to the second end of said arm (27) for respectively moving said head (28) transversly between said first and second position (7, 31) and axially to and from a position wherein it engages a central core (30) on said first reel (**2*a***).

5. A device as claimed in claim 4, characterised by the fact that said arm (27) is mounted so as to rotate about an axis parallel to said axis (9) and by virtue of said first actuating means (24).

6. A device as claimed in claim 1, characterised by the fact that said unwinding means (32) comprise an output roller (33) located along said path and cooperating with said strip material (**5*b*) on said reel (2*b*) in said second position (31**).

7. A device as claimed in claim 6, characterised by the fact that said unwinding means (32) also comprise a pressure roller (39) and actuating means (40) for moving said pressure roller (39) to and from a position wherein it engages said output roller (33).

8. A method of feeding and changing reels (2) of strip material (5) on a manufacturing machine (4), comprising:

positioning a plurality of reels (2), containing wound strip material, on a storage fixture (6);

moving a first (**2*a*) of said reels (2) to a first position (7) by a feeding means (8, 21**);

supporting the first reel (2*a*) in the first position for rotation about its axis (9);

mounting a second reel (2*b*), containing strip material (5*b*) to be unwound and supplied therefrom to a given path, on a transfer element (26) located at a second position (31);

unwinding strip material (5*b*), at a predetermined normal speed, from the strip-supplying second reel (2*b*) located on the transfer element 26 and at the second position (31), which is occupied successively by second reels (2*b*) and feeding the unwound strip material (5*b*) along the given path;

the first position (7) being within the storage fixture (6);

the second position (31) being adjacent the first position (7) and outside the storage fixture (6);

continuing to unwind strip material (5*b*) from the second reel (2*b*) until the second reel (2*b*) is nearly empty;

rotating the first reel (2*a*) about its axis (9) and unwinding strip material (5*a*) therefrom and feeding the said strip material (5*a*) along said given path while adjacent to, and at substantially the said same predetermined normal speed, as the strip material (5*b*) from the second reel (2*b*) travels along said given path;

unloading the second reel (2*b*) from the said transfer element (26) and removing the second reel (2*b*) from the second position (31);

moving the transfer element (26) to the first position (7);

rotatably mounting the first reel (2*a*) on the transfer element (26) while the strip material (5*a*) is being unwound therefrom at a normal speed; and moving the transfer element containing the first reel (2*a*) from the first position to the second position while the strip material (5*a*) is being unwound from the first reel (2*a*) and fed to the said given path at said normal speed.

9. A method according to claim 8 including:

producing a gap between said first reel (2*a*) and the other reels (2) on said storage fixture after the first reel (2*a*) has been placed in the first position.

10. A method according to claim 8 including:

unwinding the strip material (5*b*) on the second reel (2*b*) in said second position (31) at a normal speed by means of an unwinding device (32) located along the given path and with the unwinding device operatively engaging the strip material (5*b*).

11. A method according to claim 8, in which the second reel (2*b*) has a periphery, including:

supporting the periphery of the second reel (2*b*) in the second position (31) against transverse movement by guide means (35) which contacts said periphery close to where the strip material (5*b*) being unwound clears the second reel.

12. A method according to claim 11 including:

supporting and rotating the first reel (2*a*) on driven roller means (16,17) cooperating with the periphery of the first reel (2*a*);

unwinding the strip material (5*a*) on the first reel (2*a*) at said normal speed initially by the driven roller means (16,17);

operatively connecting the strip material (5*a*) on said first reel (2*a*) to the unwinding device (32); and then unwinding the strip material (5*a*) from the first reel (2*a*) at said normal speed by means of the unwinding device (32).

13. A method of feeding and changing reels (2) of strip material (5) on a manufacturing machine (4), comprising:

positioning a plurality of reels (2), containing wound strip material, on a storage fixture (6);

moving a first (2*a*) of said reels (2) to a first position (7) by a feeding means (8, 21);

supporting the first reel (2*a*) in the first position by means of driving support means (16, 17) for rotating the first reel (2*a*) about its axis (9);

mounting a second reel (2*b*), containing strip material (5*b*) to be unwound and supplied therefrom to a given path, on a transfer element (26) located at a second position (31);

unwinding strip material (5*b*), at a predetermined normal speed, from the strip-supplying second reel (2*b*) located at the second position (31) occupied successively by second reels (2*b*) and feeding the unwound strip material (5*b*) along the given path;

the first position (7) being within the storage fixture (6);

the second position (31) being adjacent the first position (7) and outside the storage fixture (6);

continuing to unwind strip material (5*b*) from the second reel (2*b*) until the second reel (2*b*) is nearly empty;

activating the driving support means (16, 17) to rotate the first reel (2*a*) about its axis (9) so as to unwind strip material (5*a*) therefrom and feed the said strip material (5*a*) along said given path while adjacent to, and at substantially the said same predetermined normal speed, as the strip material (5*b*) from the second reel (2*b*) travels along said given path;

unloading the second reel (2*b*) from the said transfer element (26) and removing the second reel (2*b*) from the second position (31);

moving the transfer element (26) to the first position (7);

rotatably mounting the first reel (2*a*) on the transfer element (26) while the strip material (5*a*) is being unwound therefrom at a normal speed; and moving the transfer element containing the first reel (2*a*) from the first position to the second position while the strip material (5*a*) is being unwound from the first reel (2*a*) and fed to the said given path at said normal speed.

* * * * *